US008919579B2

(12) United States Patent
Weigand et al.

(10) Patent No.: US 8,919,579 B2
(45) Date of Patent: Dec. 30, 2014

(54) ULTRA NARROW FLEXIBLE RETAIL DISPLAY FOR GREETING CARD AND NON-GREETING CARD MERCHANDISE

(75) Inventors: Christopher P. Weigand, Sagamore Hills, OH (US); Gary A. Hodge, Rutherfordton, NC (US)

(73) Assignee: American Greetings Corporation, Cleveland, OH (US)

( * ) Notice: Subject to any disclaimer, the term of this patent is extended or adjusted under 35 U.S.C. 154(b) by 596 days.

(21) Appl. No.: 12/776,889

(22) Filed: May 10, 2010

(65) Prior Publication Data

US 2010/0282697 A1 Nov. 11, 2010

Related U.S. Application Data

(60) Provisional application No. 61/176,604, filed on May 8, 2009.

(51) Int. Cl.
*A47F 7/00* (2006.01)
*A47F 7/14* (2006.01)

(52) U.S. Cl.
CPC ..... *A47F 7/144* (2013.01)
USPC ..... 211/55; 211/186

(58) Field of Classification Search
CPC ..... A47F 7/14; A47F 7/144; A47F 7/145
USPC ..... 211/49.1, 50, 55, 189, 206, 186, 187, 211/190, 191, 192, 193, 195, 204, 183, 211/182; 40/606.08, 124, 124.2
See application file for complete search history.

(56) References Cited

U.S. PATENT DOCUMENTS

| | | | | | |
|---|---|---|---|---|---|
| 1,380,570 | A | * | 6/1921 | Lehman | 211/60.1 |
| 1,569,358 | A | * | 1/1926 | Cross | 211/182 |
| 1,569,366 | A | * | 1/1926 | Goldberg | 211/182 |
| 1,698,974 | A | * | 1/1929 | Vance | 211/60.1 |
| 2,540,353 | A | * | 2/1951 | Schick | 108/92 |
| 2,937,767 | A | * | 5/1960 | Butler et al. | 211/191 |
| 2,991,889 | A | * | 7/1961 | Levy et al. | 211/190 |
| 3,021,961 | A | * | 2/1962 | Ruhnke | 211/190 |
| 3,110,531 | A | * | 11/1963 | Nowicki | 312/140.3 |
| 3,159,437 | A | * | 12/1964 | Jentzen | 312/108 |
| 3,179,479 | A | * | 4/1965 | Freedman | 312/140.3 |
| 3,200,961 | A | * | 8/1965 | Kolster et al. | 211/186 |
| 3,297,374 | A | * | 1/1967 | Radek | 312/108 |
| 3,305,286 | A | * | 2/1967 | Fenwick | 312/263 |
| 3,329,282 | A | * | 7/1967 | Swan et al. | 211/190 |
| 3,342,347 | A | * | 9/1967 | Berend | 211/191 |

(Continued)

*Primary Examiner* — Jonathan Liu
*Assistant Examiner* — Stanton L Krycinski
(74) *Attorney, Agent, or Firm* — Christine Flanagan

(57) ABSTRACT

An ultra narrow, tall, flexible fixture that is capable of holding and displaying greeting cards or other non-greeting card related merchandise in a retail environment. The fixture is easily configured to hold both greeting card and non-greeting card merchandise in an array of display configurations supporting different numbers of display units and shelves. Merchandize may be displayed along one length of the fixture or alternately along two opposing sides of the fixture. The fixture also contains two endcap pieces that are capable of supporting an array of unique fixtures such as gift card holders and curved card pockets. The display units contain multiple levels for storing greeting cards. The fixture additionally provides ample storage space at the base of the fixture for excess merchandise and restocking materials. An area of the fixture can also be configured to support signage and lighting. The fixture is easily installed and easily configured and re-configured according to a desired retail presentation.

4 Claims, 7 Drawing Sheets

(56) References Cited

U.S. PATENT DOCUMENTS

| | | | | | |
|---|---|---|---|---|---|
| 3,492,772 | A | * | 2/1970 | Bergman | 52/633 |
| 3,827,377 | A | * | 8/1974 | Aughtry, Jr. | 108/108 |
| 3,838,266 | A | | 9/1974 | Jonathan | |
| 3,908,830 | A | * | 9/1975 | Skrzelowski | 211/55 |
| 3,971,477 | A | * | 7/1976 | Bruderly et al. | 211/189 |
| 4,003,470 | A | * | 1/1977 | Lagorio et al. | 211/50 |
| D265,024 | S | * | 6/1982 | Johnson et al. | D6/461 |
| 4,460,097 | A | * | 7/1984 | Darnell et al. | 211/189 |
| 4,613,047 | A | * | 9/1986 | Bushyhead et al. | 211/55 |
| 4,655,353 | A | * | 4/1987 | Johnson et al. | 211/189 |
| 4,875,590 | A | * | 10/1989 | Martin et al. | 211/55 |
| 4,903,847 | A | * | 2/1990 | Duffy | 211/187 |
| 4,905,845 | A | * | 3/1990 | Broeker et al. | 211/55 |
| 4,949,849 | A | * | 8/1990 | Hardy | 211/55 |
| 5,014,862 | A | * | 5/1991 | Bustos | 211/193 |
| 5,040,688 | A | * | 8/1991 | Martin et al. | 211/55 |
| 5,167,191 | A | * | 12/1992 | Muth | 108/108 |
| 5,201,191 | A | * | 4/1993 | Bustos | 62/249 |
| 5,310,066 | A | * | 5/1994 | Konstant | 211/193 |
| 5,377,851 | A | * | 1/1995 | Asano et al. | 211/191 |
| 5,437,116 | A | * | 8/1995 | Hardy | 40/605 |
| 5,439,123 | A | * | 8/1995 | Nook | 211/187 |
| D370,140 | S | * | 5/1996 | Gaietto | D6/474 |
| 5,513,745 | A | | 5/1996 | Zoltan et al. | |
| 5,529,192 | A | * | 6/1996 | Conen et al. | 211/189 |
| 5,653,349 | A | * | 8/1997 | Dana et al. | 211/189 |
| 5,720,396 | A | * | 2/1998 | Wegscheid et al. | 211/55 |
| 5,894,946 | A | * | 4/1999 | Darnell et al. | 211/193 |
| 5,944,203 | A | * | 8/1999 | Vlah et al. | 211/189 |
| 5,947,307 | A | * | 9/1999 | Battaglia et al. | 211/187 |
| 6,029,833 | A | * | 2/2000 | Yeh | 211/189 |
| 6,068,139 | A | | 5/2000 | Brozak | |
| 6,164,467 | A | * | 12/2000 | DePottey et al. | 211/189 |
| 6,193,083 | B1 | * | 2/2001 | Wood | 211/87.01 |
| 6,267,064 | B1 | * | 7/2001 | Ostertag et al. | 108/50.02 |
| 6,427,853 | B2 | | 8/2002 | Brozak | |
| 6,427,857 | B1 | * | 8/2002 | Adams et al. | 211/189 |
| 6,467,856 | B1 | * | 10/2002 | Chang et al. | 312/108 |
| 6,530,485 | B1 | * | 3/2003 | Weber | 211/55 |
| 6,530,490 | B1 | * | 3/2003 | Kosann et al. | 211/189 |
| 6,561,366 | B2 | * | 5/2003 | Kim-So | 211/189 |
| 6,659,295 | B1 | * | 12/2003 | De Land et al. | 211/187 |
| 6,848,589 | B2 | * | 2/2005 | Wood | 211/189 |
| 6,918,499 | B2 | * | 7/2005 | De Land et al. | 211/187 |
| 6,935,523 | B2 | * | 8/2005 | Ahn | 211/195 |
| 6,955,268 | B2 | * | 10/2005 | Waldron | 211/51 |
| 7,097,049 | B1 | * | 8/2006 | Singer et al. | 211/55 |
| 7,175,034 | B2 | * | 2/2007 | Nook et al. | 211/189 |
| 7,210,587 | B1 | * | 5/2007 | Singer et al. | 211/55 |
| D584,078 | S | * | 1/2009 | Weigand | D6/473 |
| 7,523,903 | B1 | * | 4/2009 | Rindoks et al. | 248/250 |
| 7,644,527 | B2 | * | 1/2010 | Clark et al. | 40/610 |
| 7,665,617 | B2 | | 2/2010 | Shea | |
| 7,775,379 | B2 | * | 8/2010 | Hodge | 211/55 |
| 7,886,916 | B2 | * | 2/2011 | Alyn | 211/55 |
| 7,900,784 | B1 | * | 3/2011 | Weigand et al. | 211/186 |
| 7,987,998 | B1 | * | 8/2011 | Belk et al. | 211/55 |
| 2002/0060198 | A1 | * | 5/2002 | Bustos | 211/187 |
| 2004/0055187 | A1 | * | 3/2004 | Kerker et al. | 40/124 |
| 2005/0127017 | A1 | * | 6/2005 | Kessel et al. | 211/187 |
| 2005/0230338 | A1 | * | 10/2005 | Farinola et al. | 211/186 |
| 2007/0170126 | A1 | * | 7/2007 | Singer et al. | 211/55 |
| 2008/0078728 | A1 | | 4/2008 | Hodge | |

* cited by examiner

ULTRA NARROW FLEXIBLE RETAIL DISPLAY FOR GREETING CARD AND NON-GREETING CARD MERCHANDISE

RELATED APPLICATIONS

This application claims priority to U.S. Provisional Patent Application No. 61/176,604, filed on May 8, 2009, and which is incorporated herein by reference.

FIELD OF THE INVENTION

The invention is in the general field of retail displays and merchandising systems, and more particularly, displays and merchandising systems for paper and printed products including greeting cards.

BACKGROUND OF THE INVENTION

Greeting card displays as used in retail stores have been made in many forms, generally designed to neatly present a large number and variety of cards in a dense but attractive arrangement. Common features of such displays are successive rows of card shelves, tiered or vertical, with dividers on each shelf to define multiple card pockets. The shelves are attached to and supported by a back panel which is supported upon a vertically oriented frame, sometimes referred to as a "gondola". The frame or frames may include spaced-apart upright members with multiple attachment points, with other structural members attached to span between the upright members. In some greeting card displays, the shelves and pocket dividers may be rigidly attached to a back panel supported by the gondola frame by fasteners, so that any assembly or adjustment of the display requires removal and re-attachment of such fasteners. Also, the spacing of the shelves and dividers is constant, so that there is little or no flexibility to accommodate cards of different sizes in the same display, or to change the number of card pockets on any given shelf.

Some displays use a single piece back panel on which the rows or tiers of shelves are formed. In such tiered displays, the back panel is typically manufactured as a single piece in which multiple tiers are molded to form rows of card pockets. The vertical spacing of the rows is thus fixed with no provision for adjustment to accommodate cards of different sizes or to alter the card product mix of the display. Although displays of this type are economical to manufacture due to fewer required parts, flexibility is sacrificed, and the display appearance is standardized and generic.

Typically, these displays are very large, given the significant amount of merchandise that must be displayed thereon. Traditional tiered card shelves contain a single unitary tier on each side of the card shelf frame. The top of the shelf is very narrow but as the rows increase the entire display gets wider thereby utilizing significant amounts of floor space. If two or more of these displays are placed adjacent to each other on the retail display floor, aisle space is diminished, leaving little space for consumers to browse. There is a need in the art for a retail display fixture for greeting cards and non-greeting card merchandise that minimizes the floor space used by the display while maximizing the amount of merchandise that can be displayed.

SUMMARY OF THE INVENTION

In one embodiment, the ultra narrow retail display fixture of the present invention and related disclosure includes a support frame comprising a plurality of spaced apart frame members, each spaced apart frame member having a vertical section attached at one end to a horizontal member in the shape of an inverted letter T, each pair of spaced apart frame members being connected by at least two horizontal support rails that span between the vertical section of the spaced apart frame members and at least two horizontal base support rails that span between the horizontal section of the spaced apart frame members, a base member that is attached to each end of the support frame, at least one shelf engaged with two of the plurality of spaced apart frame members, the display fixture having a width no wider than 20 inches.

In another embodiment, the ultra narrow retail display fixture further includes at least one endcap panel attached to each end of the display fixture and a fixture being attached to each endcap that includes a plurality of gift card holders, a plurality of curved card pockets or a wire grid panel.

In yet another embodiment, the ultra narrow retail display fixture further includes a plurality of card tiers, a plurality of pegboard panels, a plurality of slatwall panels or a combination thereof.

In still another embodiment, the ultra narrow retail display fixture further includes a door located between each pair of the plurality of spaced apart upright members which allows access to a storage space, lighting and means to attach the lighting to the display fixture, and signage and means to attach the signage to the display fixture.

DETAILED DESCRIPTION OF PREFERRED AND ALTERNATE EMBODIMENTS

The fixture of the present invention and related disclosure is an ultra narrow, tall, flexible fixture that is capable of holding and displaying, greeting cards or other non-greeting card related merchandise in a retail environment. The fixture is easily configured to hold both greeting card and non-greeting card merchandise in an array of display configurations supporting different numbers of display units and shelves. Merchandise may be displayed along one length of the fixture or alternately along two opposing sides of the fixture. The fixture also contains two endcap pieces that are capable of supporting an array of unique fixtures such as gift card holders and curved card pockets. The display units contain multiple levels for storing greeting cards. The fixture additionally provides ample storage space at the base of the fixture for excess merchandise and restocking materials. An area of the fixture can also be configured to support signage and lighting. The fixture is easily installed and easily configured and reconfigured according to a desired retail presentation.

Figure 2:
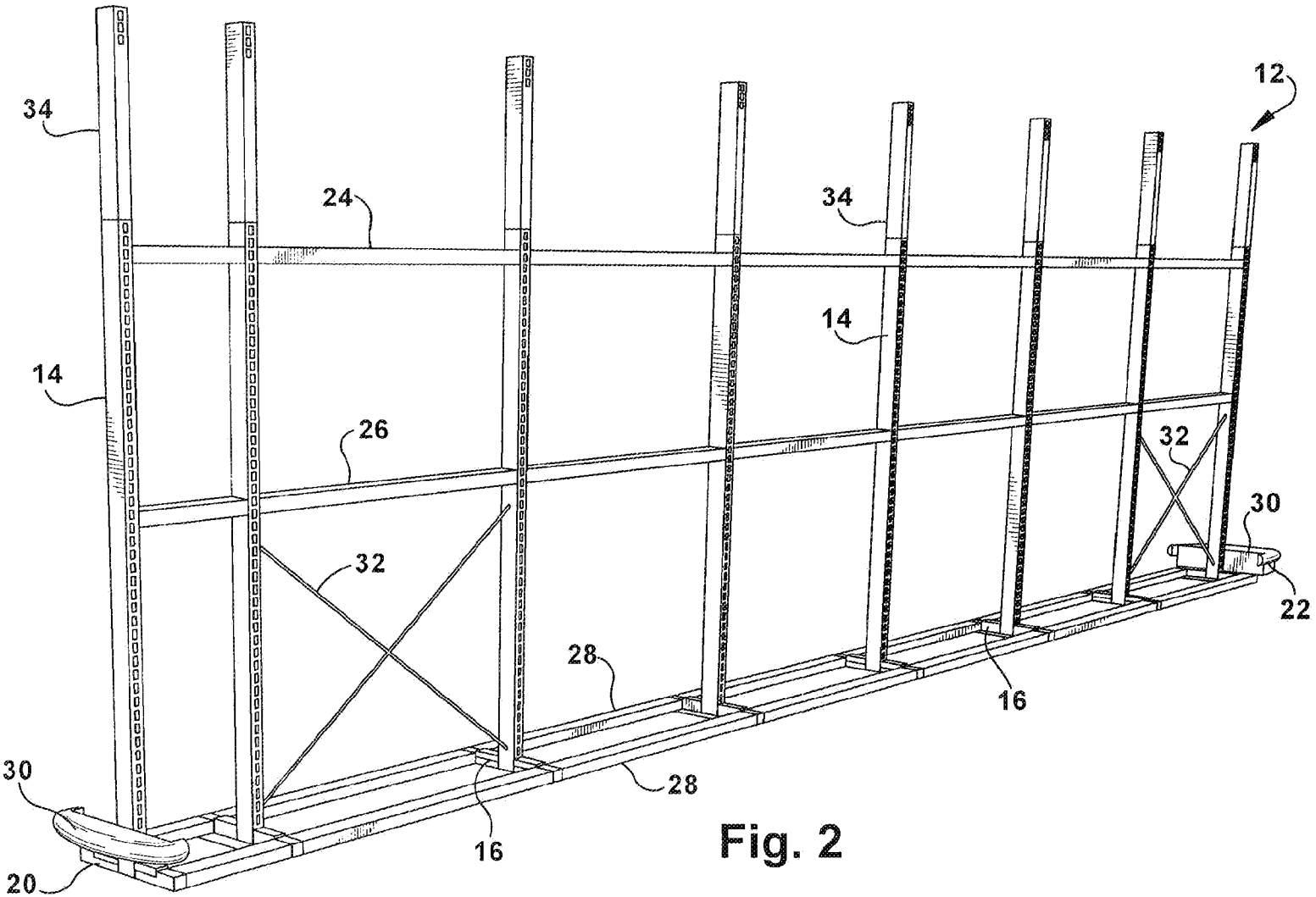
FIG. 2 is a plan view of the support frame of the retail display of the present invention.
Figure 3:
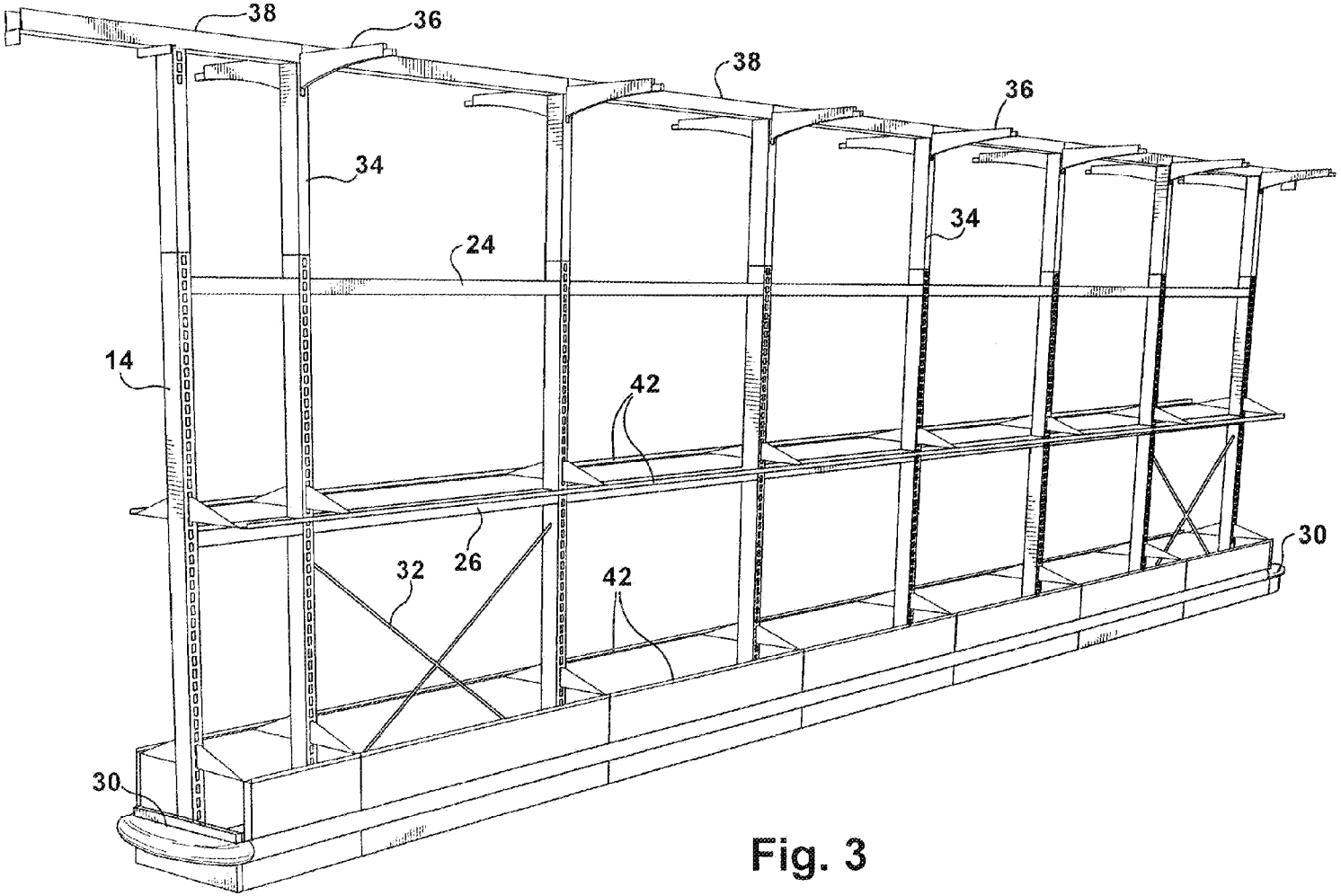
FIG. 3 is a plan view of the support frame of FIG. 2 with shelving units, light mounting arms and wire channel.

Turning to the figures, the display, indicated in its entirety at 10, includes a support frame 12 having a plurality of spaced apart slotted upright frame members 14 that bisect a horizontal frame member 16, forming the shape of an inverted letter T. The horizontal frame members 16 serve as feet or a base providing stability to the slotted upright vertical frame members 14. The support frame 12, which can be seen in FIGS. 2 and 3, is in one form generally rectangular, with two longitudinal sides 18 and ends 20, 22 which span and define a width of the display 10. Each pair of slotted upright vertical frame members 14 is spaced apart along the longitudinal side 18 of the fixture to define a length dimension of the fixture 10. Each spaced apart slotted upright frame member 14 contains plurality of holes or slots contained on two opposing surfaces, which are configured for the attachment of a variety of display fixtures. The spaced apart upright frame members 14 are connected by a top tier support rail 24, a middle tier support rail 26 and two base support rails 28. The slotted upright members 14 are preferably spaced approximately 48 inches apart but may be spaced at any desired length interval. The length of the entire display 10 may range from approximately 20 to approximately 35 feet long and may range from approximately 64 to approximately 96 inches high. The width of the completed fixture 10 is preferably 18 inches wide but may extend out to approximately 20 inches in width. This tall, narrow configuration provides several advantages over traditional greeting card fixtures such as, providing more aisle space and providing the ability to display more merchandise while taking up less retail floor space. Greeting card departments are often made up of several fixtures arranged in parallel with approximately 4 to 5 feet between each fixture. Given that the amount of square footage allotted to a greeting card department is at an absolute premium in a retail environment, it is important to be able to make the most of the allotted space in terms of the volume of merchandise displayed while giving an uncluttered appearance as well as providing for wide open aisles between fixtures. A traditional greeting card display fixture may range in width from approximately 36 to approximately 48 inches wide. Considering that the fixture of the present invention takes up in some cases, half the width or less of a traditional fixture, the total number of fixtures that can comfortably be configured into an allotted retail space increases by one or perhaps more over the total number of traditional fixtures that can fit in the same allotted space.

A small or large end base member 30 may be attached to each end of the frame structure 12. The base member 30 is substantially rectangular with an outwardly curved or bowed outside edge, which is designed to deflect and protect the display from direct impact caused by shopping carts and the like. The width of the base member 30 is equal to the width of the horizontal tube frame section 16 of the base of each slotted upright vertical frame member 14. The length of the base member 30 may vary depending on whether a small or large base member is used.

In order to stabilize and secure the tall, narrow display 10 in place, the display 10 is anchored directly to the floor in multiple points along the width of the fixture. A plurality of anchor brackets may be used for this purpose. Anchor brackets are designed to fit over each of the horizontal tube frame section 16 of each slotted upright vertical frame member 14. The anchor bracket is generally shaped like an inverted letter U, having a top horizontal portion attached at each end to a vertical portion creating a channel that fits directly over each horizontal tube frame section 16. One of the vertical portions of the anchor bracket extends down to the floor and extends outward in a vertical direction in the form of a flange which sits flush with the floor. The flange contains a pre-positioned hole at the approximate vertical center of the flange which is designed to accommodate a bolt or other attachment means. Attaching the fixture directly to the floor ensures stability and secures the tall, narrow display 10 in place.

As an additional stabilization measure, a pair of wire braces 32, which are configured in a diagonal, x-shaped arrangement, may be placed between one or more sets of adjacent slotted upright vertical frame members 14 between the bottom of the frame and the middle tier support rail 26. Each wire brace 32 would attach at one end to a first upright vertical frame member and at the opposite end to a second upright slotted vertical frame member which is adjacent to the first upright vertical frame member. The wire braces 32 provide improved rigidity and stability of the overall skeletal structure of the display 10.

Figure 1:
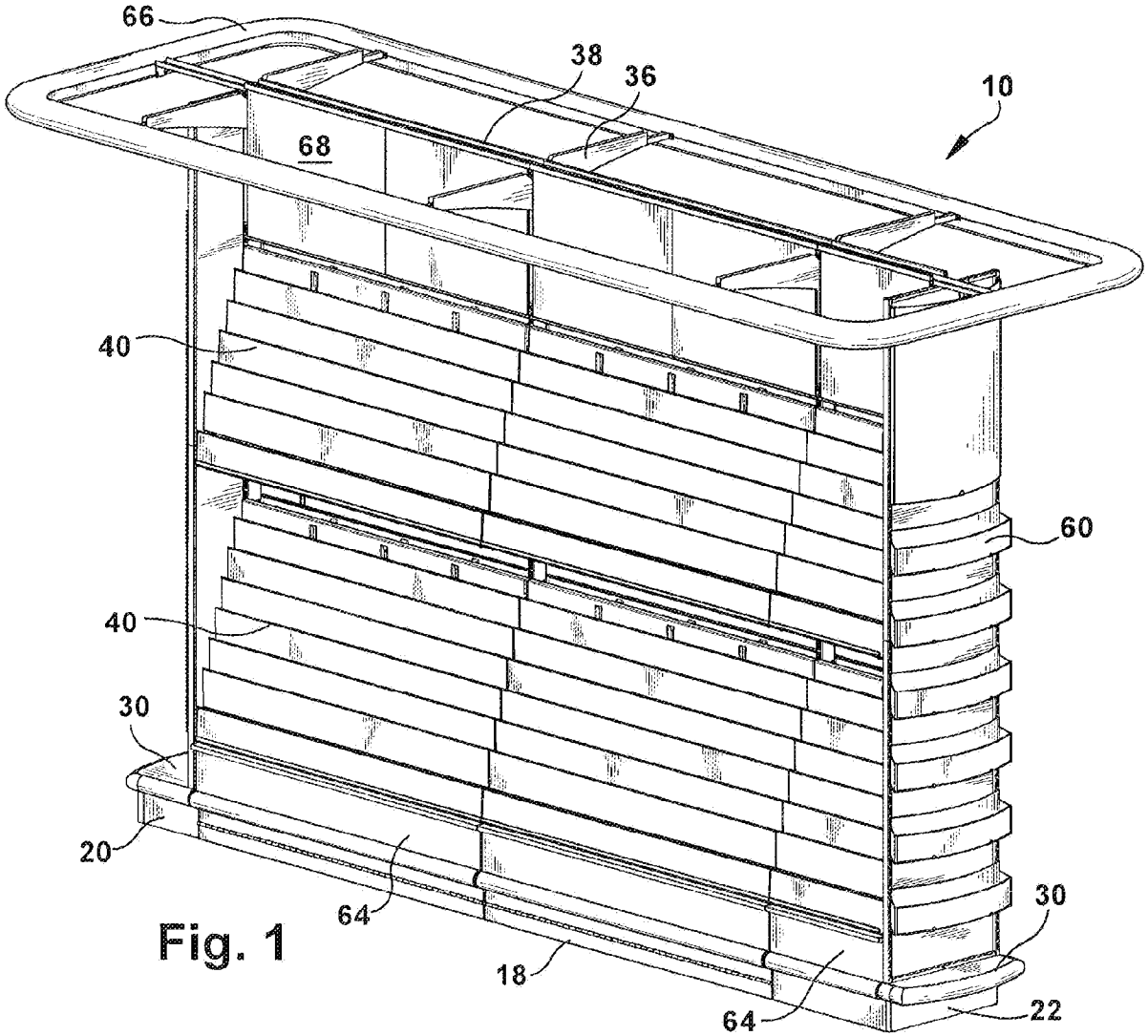
FIG. 1 is a plan view of the retail display of the present invention

In addition to providing ample space for displaying greeting cards and non-greeting card merchandise, the ultra narrow display fixture of the present invention additionally contains significant space for displaying signage, as shown in FIG. 1. For example, an upright extender 34 may be placed at the top of each slotted upright vertical frame member 14. The slotted upright vertical frame members 14 are preferably square or rectangular shaped creating a hollow inside cavity. The top of each slotted upright vertical tube frame member is open and configured to receive a substantially square or rectangular shaped upright extender 34. Each upright extender 34 is substantially shaped and dimensioned to be identical to the upright vertical frame members 14. One end of each upright extender 34 is slightly smaller in size and configured to fit within the inside cavity of each slotted upright vertical frame member 14. The upright extenders 34 can simply be dropped into the top of each slotted upright vertical frame member 14 to extend the height of the fixture creating space above the merchandise display area in which signage can be attached. Additionally, the upright extenders 34 may be used to attach light mounting arms 36 and/or to support wire channels 38 along the top of the display 10.

In a preferred embodiment, each pair of adjacent spaced apart slotted upright frame members 14 of the display supports two shelving units 42, as shown in FIG. 3. Alternate embodiments may support three or more shelving units 42 or other display fixtures. Each shelving unit 42 spans between two vertical upright frame members 14 and is attached directly to the frame members 14. Each shelving unit 42 contains a horizontal planar shelf bottom, a vertical shelf front that is perpendicular to the planar shelf bottom, and two side shelf panels that are perpendicular to the planar shelf bottom. The ends of each of the side shelf panels include brackets which are configured to engage with the slotted upright vertical tube frame members. A bottom shelf 42 is attached near the bottom of each pair of adjacent spaced apart slotted frame members 14 and a top shelf 42 is attached near the vertical midsection. The width of each shelf 42 can range from approximately 18 inches to approximately 48 inches, depending on the space between each pair of spaced apart slotted upright frame members 14. Shelving units 42 may be attached to both longitudinal sides of the display, creating a two-sided display unit, or the shelves 42 may be placed on a single longitudinal side for a single sided display.

Figure 4:
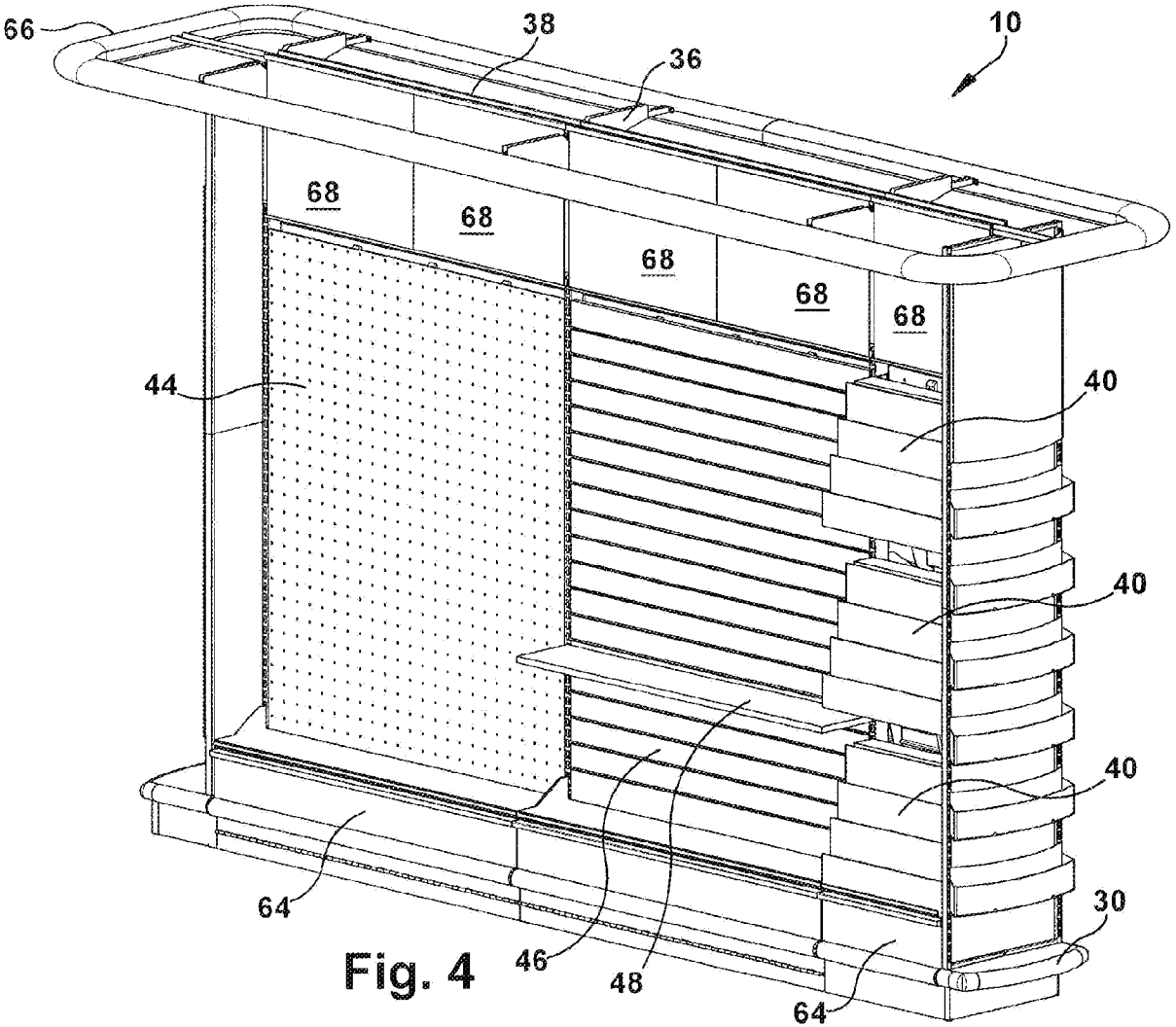
FIG. 4 is a plan view of the retail display showing a pegboard panel, slatwall panel, and card tier configurations.

Each shelving unit 42 is capable of supporting one greeting card tier 40, each greeting card tier 40 containing a plurality of rows, as shown in FIGS. 1, 4 and X. The tiers 40 are preferably made of vacuum formed plastic but may be made of metal, aluminum or any other suitable material. Each tier 40 contains two or more rows which are arranged in a cascading manner as shown in the figures. Starting with the row at the highest elevation of the tier, each subsequent row is located at a lower elevation and at a position slightly in front of the previous row. This layered or tiered row configuration provides maximum space for displaying greeting cards while allowing good visibility to each of the greeting cards contained in each row of the tier 40. The use of two or more tiered rows instead of a single tier allows the fixture to remain narrow and maximizes the use of the allotted space. In a preferred embodiment, an upper or top tier contains six rows and a lower or bottom tier contains seven rows. Each card tier 40 sits or rests upon a 42 shelving unit and is attached to the upper or lower tier support rail 24, 26 located between each pair of spaced apart slotted upright members 14.

In an alternate embodiment, the fixture 10 may be configured to display non-greeting card merchandise. In this case, instead of greeting card tiers 40, a plurality of pegboard panels 44, slatwall panels 46, or shelves 48 may be installed between each pair of spaced apart slotted upright members 14, as is shown in FIG. 4. The pegboard 44 or slatwall 46 panels may be attached to each pair of spaced apart slotted upright members 14 or the panels may be inserted at a top edge into a channel installed at the bottom of the upper tier support rail 24 and at a bottom end, the panel may rest on a bottom shelving unit 42. The fixture can easily be re-configured to change between displaying greeting cards to displaying non-greeting card merchandise. The display may also contain greeting card tiers 40 on one side of the display while having pegboard 44 or slatwall 46 panels on the opposite side of the display to display non-greeting card merchandise. Also, a single side of the fixture can have a combination of greeting card tiers 40, pegboard 44, slatwall 46, or any combination thereof.

Figure 5:
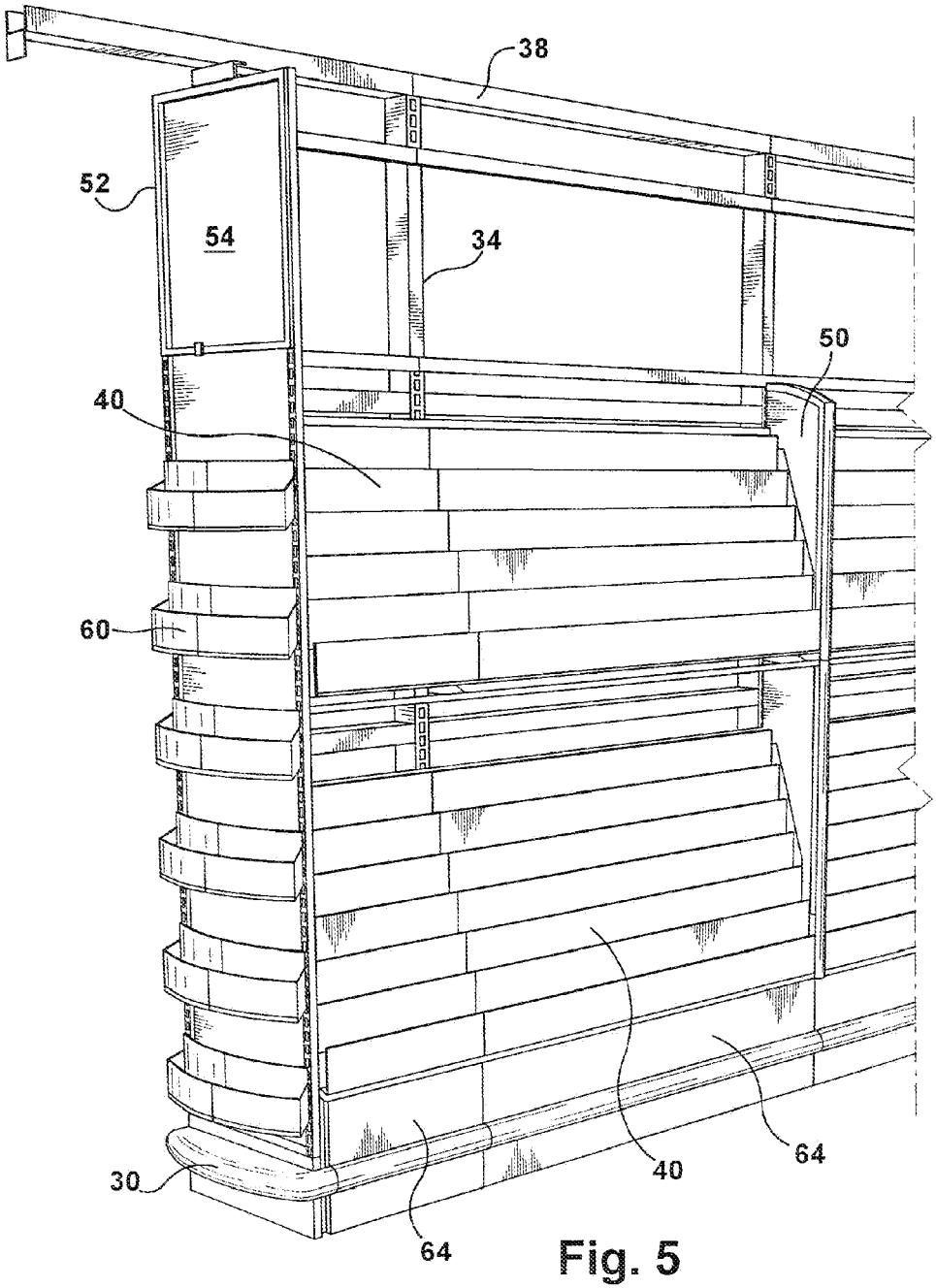
FIG. 5 is a plan view of the retail display of the present invention with divider panels attached thereto.

The greeting card tiers 40, shelves 48, or panels 44, 46 can be divided into sections by the use of optional divider panels 50, shown in FIG. 5. One or more divider panel 50 can be attached to the display area to create shopping zones or to segment themed merchandise. For example, the area between two divider panels 50 can be dedicated to female birthday cards, blank cards or to Halloween, Christmas or other seasonal occasion cards. The zones or segments may further be distinguished or segmented by signage attached above each zone.

Figure 6:
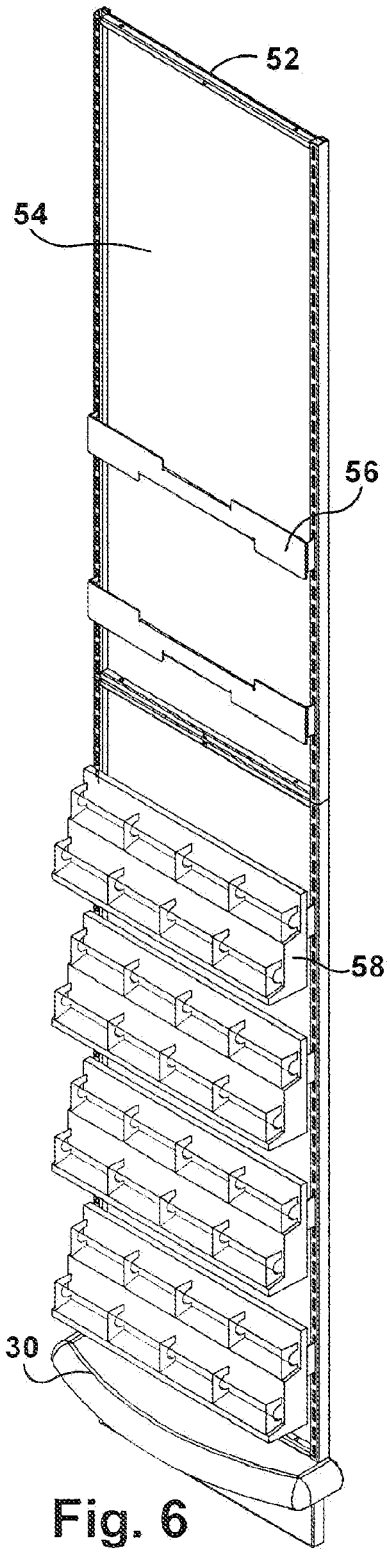
FIG. 6 is a plan view of an endcap with multiple gift card holders attached thereto.
Figure 7:
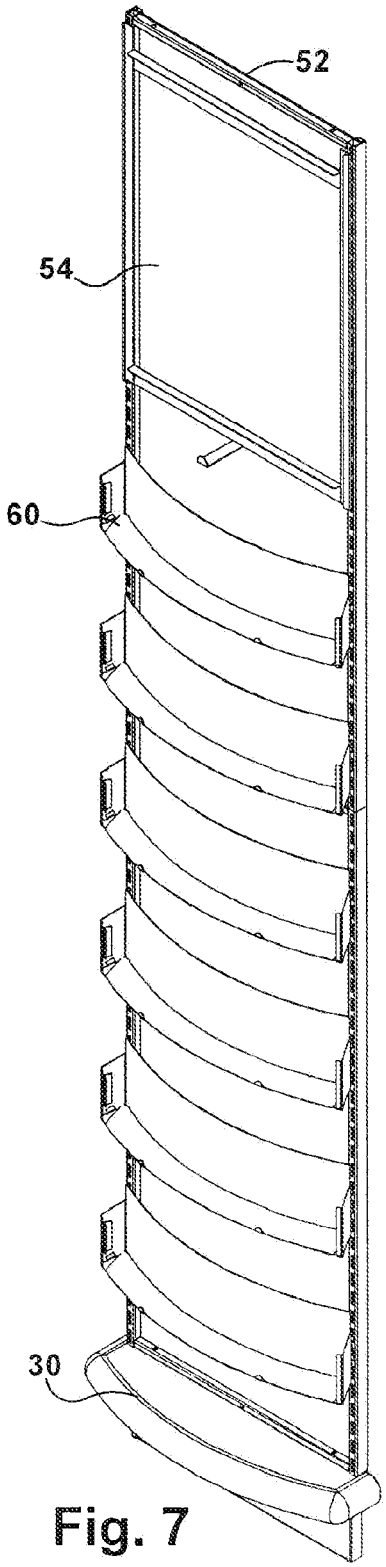
FIG. 7 is a plan view of an endcap with multiple curved card pockets attached thereto.
Figure 8:
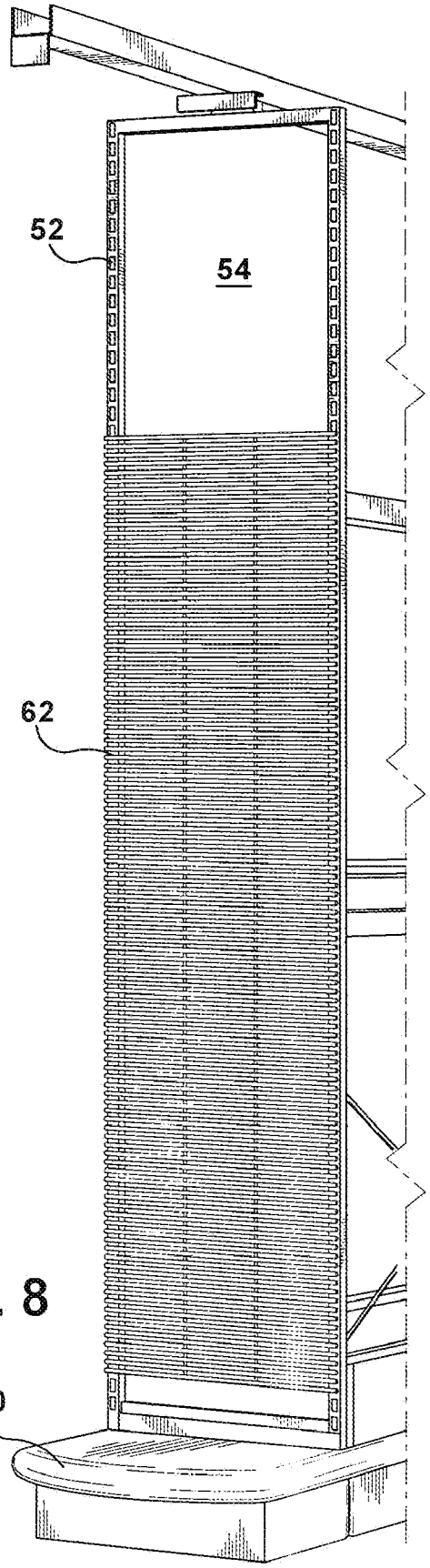
FIG. 8 is a plan view of an endcap with a wire grid panel attached thereto.

Another flexible feature of the display fixture 10 of the present invention is the ability to choose different types of endcap panel 52 fixtures. One endcap panel 52 is located at each end 22 of the narrow, rectangular display fixture 10. The endcap panels 52 maximize the amount of product that can be displayed while the overall fixture, given its narrow configuration, minimizes the total retail floor spaced required. Also, the endcap panels 52 may, for example, display gift cards, stickers, seasonal greeting cards or other merchandise that may catch a consumer's attention while traveling down a main retail aisle. This endcap merchandise can be used to persuade or encourage consumers to visit the greeting card aisle or remind them to purchase a greeting card or gift card for an upcoming event or holiday. Each endcap 52 contains one or more endcap back panels 54 that consist of a rectangular shaped panel framed at each side by two slotted vertical uprights and at the top and bottom by two horizontal members with one or more pre-positioned holes thereon. The endcap back panel 54 serves as a solid backing structure which may support a variety of merchandise fixtures. For example, as shown in FIG. 6, a plurality of gift card holder brackets 56 may be attached to the slotted vertical uprights of the endcap back panel 54. The gift card holder brackets 56 include an elongate planar front member connected to a bottom or floor member that is positioned perpendicular to the planar front member and two side brackets, also perpendicular to the planar front member, configured for attachment to a slotted vertical, upright. Each gift card holder bracket 56 can support a gift card holder 58 which typically consists of a plastic vacuum formed container with separate pockets or openings in which gift cards may be displayed. Turning to FIG. 7, the endcap back panel 54 may alternately support a plurality of curved greeting card pockets 60 for displaying greeting cards. The greeting card pockets 60 may be attached directly to the slotted vertical uprights of the endcap back panel 54 at different elevations. As shown in FIG. 8, the endcap 52 may be configured with a wire grid 62. The wire grid 62 may support peghooks or other attachment fixtures that non-greeting card merchandise, such as invitations, party favors, and stationery can be displayed upon.

The ultra narrow merchandise fixture of the present invention not only minimizes floor space while maximizing the product display area, but additionally provides a convenient merchandise storage area. The empty space beneath the floor and the bottom card shelf 42 can be used to store merchandise. A plurality of doors 64 is installed at the base of the fixture to conceal and provide access to this storage area. This area can be used to store excess merchandise that can be used to replenish the stock once items have been depleted. A planar piece of material, such as cardboard, fiberboard, or other such material, may be placed along the bottom of the fixture, between each pair of spaced apart slotted upright frame members to avoid placing merchandise directly on the floor. Each door panel 64 is attached to each base rail located between each pair of spaced apart slotted upright frame members. The door 64 is able to pivot in a downward direction to enable access to the storage space beneath the fixture. The top edge of each door 64 contains one or more magnets that are used in combination with one or more magnets contained on the lower or bottom 42 unit to keep the door 64 in a closed position. Each door 64 contains a small lip or handle along the top edge that can be used for opening the door. Having a storage area in combination with a merchandise display decreases the amount of merchandise that a retailer must store in backrooms or warehouses and additionally aids in restocking depleted merchandise.

As mentioned above, the fixture can further include upper wire channels 38 and light mounting arms 36. An upper wire channel 38 is a u-shaped channel that can be connected between the tops of the upper extenders 34 that can be used to house or contain any wiring for electrical devices or act as a sign mount. The upper wire channels 38 also structurally tie the top of the slotted upright frame members 14. Light mounting arms 36 may also be attached to pre-positioned holes or slots contained in each upper extender. Each light mounting arm 36 consists of two substantially rectangular planar pieces of metal or other suitable material that contain a bracket at one end configured to engage with the pre-positioned holes or slots contained in each upper extender 34. The other end, opposite the bracket, contains a small perpendicular element used to support a light fixture 66.

The display fixture additionally contains significant space to display signage 68. An upper sign channel may be attached to the bottom surface of the upper wire channel 38 and a lower sign channel may be attached to the top surface of the top tier support rail 24. Signs 68 can be secured to the fixture by inserting the top edge of the sign 68 within the upper sign channel and the lower edge of the sign 68 within the lower sign channel. One sign 68 may be inserted between each pair of spaced apart upright frame members 14.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An ultra narrow retail display fixture comprising:

a support frame comprising a plurality of spaced apart frame members, each spaced apart frame member having a vertical section and a horizontal section, the vertical section being perpendicular to the horizontal section which is located at a base of the vertical section, forming the shape of an inverted letter T, the plurality of spaced apart frame members being connected by a first horizontal support rail located proximate to a vertical midsection of the display fixture, a second horizontal support rail located proximate to an upper section of the display fixture, and a rectangular support structure located at a bottom section of the display fixture, the first and second horizontal support rails and the rectangular base support structure spanning the length of the display fixture;

a plurality of shelves attached between each of the plurality of spaced apart frame members, each shelf having a horizontal shelf bottom, two side panels located on opposite ends of the horizontal shelf bottom, and a lip which extends upward from the front-most edge of the horizontal shelf bottom, each shelf operative to support one greeting card tier, each greeting card tier resting on one of the plurality of shelves and also attached to the first or second horizontal rail;

a vertical endcap panel attached to each of a first and second end of the support frame, the vertical endcap panel substantially extending from the base of the display to a top of the display; and the display fixture being anchored directly to the floor.

2. The ultra-narrow retail display fixture of claim 1, wherein a fixture is attached to the vertical endcap panel, the fixture being selected from the list of gift card holder, pocket and wire grid panel.

3. The ultra narrow display fixture of claim 1 further including an upright extender attached to the top end of each of the plurality of spaced apart upright frame members.

4. The ultra narrow retail display fixture of claim 3 further including two light mounting arms attached to each upright extender and lighting means attached to said light mounting arms.

* * * * *